US005537096A

United States Patent [19]

Wagner

[11] Patent Number: 5,537,096

[45] Date of Patent: Jul. 16, 1996

[54] FIRE DETECTING DEVICE

[75] Inventor: Ernst-Werner Wagner, Winsen, Germany

[73] Assignee: Wagner Alarm- und, Langenhagen, Germany

[21] Appl. No.: 517,073

[22] Filed: Aug. 21, 1995

Related U.S. Application Data

[63] Continuation of Ser. No. 75,570, Jun. 16, 1993, abandoned.

[30] Foreign Application Priority Data

Oct. 17, 1991 [DE] Germany ..... 41 34 400.6

[51] Int. Cl.[6] ..... G08B 23/00

[52] U.S. Cl. ..... 340/693; 340/628; 340/584

[58] Field of Search ..... 340/693, 628–630, 340/632, 603, 584, 586, 577–578; 73/863.41, 863.51, 23.25, 23.26, 25.01; 169/61; 374/141, 147, 148; 236/DIG. 8, 49.2, 94; 454/28, 369; 431/16, 22; 122/504.2

[56] References Cited

U.S. PATENT DOCUMENTS

| | | | |
|---|---|---|---|
| 3,952,808 | 4/1976 | Richardson | 169/61 |
| 4,177,461 | 12/1979 | Brown et al. | 340/628 |
| 4,254,414 | 3/1981 | Street et al. | 340/627 |
| 4,330,808 | 5/1982 | Sawada et al. | 340/628 X |
| 4,351,701 | 9/1982 | Bauer | 340/628 X |
| 4,364,032 | 12/1982 | Narato et al. | 340/584 X |
| 4,419,658 | 12/1983 | Jarosz et al. | 340/521 |
| 4,613,297 | 9/1986 | Zanias et al. | 431/16 |
| 4,630,037 | 12/1986 | Escamilla, Jr. | 340/628 |
| 4,733,225 | 3/1988 | Uematsu et al. | 340/584 |
| 4,785,288 | 11/1988 | Heberlein, Jr. et al. | 340/628 |
| 4,864,283 | 9/1989 | Seto | 340/584 |
| 5,023,601 | 6/1991 | McGannon | 340/628 |
| 5,260,691 | 11/1993 | Shyu | 340/693 X |
| 5,280,802 | 1/1994 | Comuzie, Jr. | 340/632 X |

FOREIGN PATENT DOCUMENTS

| | | |
|---|---|---|
| 0459944A1 | 12/1991 | European Pat. Off. . |
| 2523455 | 9/1983 | France . |
| 3433459A1 | 3/1986 | Germany . |
| 2175693 | 3/1986 | United Kingdom . |

*Primary Examiner*—Thomas Mullen
*Attorney, Agent, or Firm*—Bell, Seltzer, Park & Gibson

[57] ABSTRACT

A device is adapted for attachment to and for detecting fire in ventilated appliances and machines. The device includes a measuring chamber in the form of a chimney having a lower cross sectional opening adapted to be placed on at least a part of an air outlet of the ventilated appliance or machine to receive at least a portion of the ventilated air therefrom for flow therethrough. At least one fire detector is positioned in the measuring chamber in the path of air flow therethrough for sensing a fire and is adapted to be connected to an alarm and an extinguishing and/or switch-off device for the appliance or machine.

9 Claims, 9 Drawing Sheets

FIRE DETECTING DEVICE

This application is a continuation of application Ser. No. 08/075,570, filed as PCT/EP92/02092, Sep. 11, 1992, published as WO93/08549, now abandoned.

FIELD OF THE INVENTION

The invention relates to a device for detecting fire in ventilated appliances or machines, such as electronic data processing equipment and similar electronic means, comprising a measuring chamber through which flows the main current of cooling air or a representative fraction thereof and further comprising at least one detector arranged in the measuring chamber in the air flow for sensing a fire characteristic magnitude and connected to an alarm means, an extinguishing and/or a switch off device, for example by way of an electronic circuit.

The invention also relates to a device of the kind mentioned above which additionally comprises an exhaust air channel supplying the main current of cooling air or the representative fraction thereof to the measuring chamber.

BACKGROUND OF THE INVENTION

Such devices are known also, for instance, by the technical term "equipment protection devices". Typical fields of application for equipment protection devices are electronic data processing installations, especially individual components thereof, and similar electronic equipment, such as measuring, regulating and control units, switching and exchange apparatus, CNC production machines and industrial robots, CAD/CAM systems, as well as printers. It is likewise known that the electronic modules of such instruments or machines must be cooled, for instance by ventilation, because of the heat they develop, a distinction being made, in accordance with the generation of the ventilation, between forced ventilation type apparatus, on the one hand, with which the cooling air stream is generated by a fan inside the apparatus and naturally ventilated apparatus, on the other hand, with which convection of the room air, either natural or produced by air conditioning apparatus, is utilized by virtue of the particular arrangement of the equipment at the place of installation. The term "fire characteristic magnitude" is used to designate physical magnitudes underlying measurable alterations in the surroundings of a nascent fire, such as the ambient temperature, the contents of solids, liquid, or gas in the ambient air (formation of smoke—particles or aerosols—or vapor) or ambient radiation.

The significance of fire detecting devices or in short: equipment protection devices is on a constant rise in parallel with the greatly increasing dependence on electronic data processing or electronically controlled manufacturing processes in companies of all kinds. Whereas fire protection measures, until some years ago, still were tailored to preserving the buildings, nowadays fires must be detected as early and as reliably as possible at the appliances or machines themselves in order to recognize a fire in its originating phase already. The shortest possible time span between the moment of origination of a fire and the moment of detection of the fire, as well as the corresponding measures, is of the greatest importance, for example, with the electronic equipment mentioned intially, especially because with such equipment it is not the primary damage to the particular appliance which is decisive but instead the secondary damage caused by strong development of smoke in the affected room. After all, the material subject to burning above all is plastics, like PVC and polyethylene, such as used in cable insulations which release hydrochloric acid gases upon combustion, reacting with water withdrawn from the humidity of the air to form hydrochloric acid. The latter then deposits as very fine fog on the appliances or machines in the room and also enters into them via the room air. As a consequence corrosion processes take place whose repair often leads to shut-down of an entire plant.

The difficulty with early detection of fires in ventilated appliances or machines or, generally, in the rooms in which such appliances are installed lies in the circulation of the air generated by ventilation of the appliances or of the room, which circulation is intended with the aim of obtaining the best possible cooling. In air conditioned rooms, for example in computer centers, the currents of air which predominantly are directed from the bottom to the top often do not reach the ceiling of the room so that smoke contained in the air stream can be detected only very late by the known spot alarms frequently installed at the ceiling. Another aspect is that the main current of cooling air in a modular type of apparatus, for instance, may change due to the fact that first the apparatus is being used with less slide-in units and, subsequently, the addition of further slide-in units will considerably alter the distribution of cooling air. As a result, the placing of the conventional spot alarms later on often is no longer correct.

It was in recognition of this fact that the fire detecting devices mentioned initially were developed whose measuring chamber is put directly on the apparatus to be monitored. These known fire detecting devices, for example, suck a fraction of the main cooling air stream through a fan and deliver this cooling air stream to the detectors located in the measuring chamber. To be able to detect the main current of cooling air, these known fire detecting devices aspire the partial air by means of funnels or suction tubes placed on the air outlet openings of the ventilated appliance or machine. In this context it must be observed that regulations stipulate that the cooling air stream of the corresponding appliances not be impaired.

The problem with these known fire detecting devices is that due to the constant change in apparatus technology the masses of air flow and also the flow velocities steadily increase so that it becomes ever more difficult to tap a fraction off the main current of cooling air of the ventilated appliance and permit reliable detection of a fire characteristic magnitude under good measuring conditions, especially the fire characteristic magnitude "proportion of solids or liquid in the air". Frequently the situation is such that a strong vortex forms in the cooling air under the funnels or in the measuring chamber so that it would take too long to detect, for instance, solid particles in the cooling air (smoke). The detection times, when using the known fire detecting devices of the kind mentioned initially, are approximately 60 seconds which still is too long.

OBJECT AND SUMMARY OF THE INVENTION

This problem is the point of departure of the instant invention which is considered to have for its object the shortening of the detection period as well as increasing the reliability of the known fire detecting devices.

This object is met, in accordance with the invention, with a device for detecting fire in ventilated appliances or machines, such as electronic data processing equipment and similar electronic means, comprising a measuring chamber through which flows the main current of cooling air or a representative fraction thereof and further comprising at least one detector arranged in the measuring chamber in the air flow for sensing a fire characteristic magnitude and connected to an alarm means and an extinguishing and/or a switch off device, for example by way of an electronic circuit, in that the measuring chamber is designed as a chimney having a lower cross sectional opening which is placed on a part cross section of the air outlet of the ventilated appliance or ventilated machine.

The "detection chimney" according to the invention, acting by the effect of draft as known from the design of furnaces, makes sure that the whirled up cooling air leaving the air outlet of the ventilated appliance or ventilated machine is steadied and converted into a laminar flow of cooling air. This laminar flow of cooling air sweeps by the detector disposed in the detection chimney, thus permitting an extremely quick and reliable detection of solid or liquid proportions in the cooling air. Detection periods of a few seconds can be achieved by the fire detecting device according to the invention.

The advantages of the device according to the invention furthermore reside especially in the fact that the fraction of air tapped from the principal cooling air stream need not be fed to the measuring chamber through another fan which would cause additional whirling up of the cooling air, instead the cooling air is passed through the measuring chamber by utilizing the per se known chimney effect. In addition, the fire detecting device according to the invention can do with a smaller dimensioned power supply unit since no additional energy is needed for a fan, apart from the energy to be furnished for the detector or detectors.

Advantageous further developments of this solution according to the invention are described below.

For instance, adaptation of the detection chimney to varying quantities of air flow and also to varying flow velocities advantageously is obtained by the fact that the length of the chimney is variable in longitudinal direction of the cooling air flow passing through. With a great mass of cooling air flow or high flow velocities, therefore, the length of the detection chimney is increased until laminar flow conditions are established at the detector located in the detection chimney.

The invention provides two advantageous alternatives for this adaptation in length. According to the first solution the change in length is effected by plug-in inserts which either are added or removed. According to an alternative solution the detection chimney is made to a length which corresponds to the particular place of application.

It was explained initially that it is necessary to detect the main current of cooling air by a fire detecting device. To guarantee this even more effectively, preferably an exhaust air dome is arranged between the chimney or the lowest inert and the air outlet from the ventilated appliance or ventilated machine, the cross section of the dome widening in the direction of the air outlet. This widening of the cross section most preferably may terminate in circular shape by which it becomes possible to guide the cooling air flow especially free of vortices.

Of course, the fire detecting device according to the invention can be used also with ventilated appliances or machines which have the air outlet located laterally. In this case either the exhaust air dome or one of the plug-in inserts or the detection chimney itself may be formed with a 90° bend, for example, so as to guide the cooling air flow in the detection range in vertical direction, if at all possible, whereby the formation of vortices is further reduced. With such an angular detection chimney, it is preferably provided that the detector be located in a section of the chimney which takes a linear course so as to safeguard a laminar flow in the detection range.

The laminar flow of the cooling air is enhanced still further by an advantageous modification of the invention according to which the cross section of the chimney converges in the direction of flow. As is well known, this tapering of the cross section increases the flow velocity and that counteracts the formation of vortices or dissolves existing vortices.

For the frequent case of a plurality of ventilated appliances or machines being positioned closely adjacent one another, it is provided in particularly preferred manner that the chimney is placed on an exhaust air channel which withdraws a partial amount of the main current of cooling air of each ventilated appliance or each ventilated machine and feeds it to the lower cross sectional opening of the chimney—or that of the exhaust air dome.

The object underlying the invention, moreover, is met with the known device specified above which, in addition, comprises an exhaust air channel supplying the main current of cooling air or the representative fraction thereof to the measuring chamber, in that the measuring chamber is designed as a flat box, open at two sides, having one open face end connected to the outlet of the exhaust air channel, that the exhaust air channel likewise is of box-shaped design and includes a cover with sidewalls attached to it, and that the exhaust air channel box is placed with its open bottom on the air outlet of the ventilated appliance.

The advantages of this solution according to the invention, above all, reside in the space-saving flat design of the exhaust air channel and measuring chamber. Therefore, this embodiment of the fire detecting device is suitable wherever there is not so much space available above or at the side of the ventilated appliance to be protected—depending on the place of installation of the device—or where the overall impression of the equipment is not be disturbed by a measuring chamber projecting upwardly. With this flat embodiment of the fire detecting device the desired laminar cooling air flow is generated inside the exhaust air channel already into which the cooling air flows into the exhaust air channel box to be moved in the direction of the measuring chamber. Moreover, this embodiment of the fire detecting device is useful wherever the air outlet of the ventilated appliance includes guide vanes which already divert the cooling air flow which exits from the air outlet at a certain angle with respect to the plane of the air outlet, for example 45°. The fraction tapped from the main current of cooling air thus also flows at the same angle into the exhaust air channel box, whereby accumulation or reflux of the cooling air by reflection at the underside of the cover of the exhaust air channel box is avoided. If, for instance, the partial amount withdrawn from the cooling air flow enters at an angle of 45° into the exhaust air channel box, the cooling air at the underside of the cover is deflected once more by 45° and, therefore, flows in steadied fashion in the direction of flow towards the measuring chamber.

Preferred modifications of this solution according to the invention are described below.

For all those ventilated appliances whose air outlet consists of a simple grid so that the issuing cooling air flows out of the appliance vertically with respect to the grid, it is preferably provided that the exhaust air channel box is of two-part design in that the cover and the sidewalls form an upper part and that a lower part is provided which comprises finlike air inlet slots in its bottom, the fins thereof being of inclined design in the direction of flow, the lower part being adapted to be inserted from below into the upper part.

The fins, for example, may extend at an angle of 45° with respect to the bottom of the exhaust air channel. The cooling air which exits vertically out of the air outlet of the ventilated appliance thus is deflected for the first time by the fins of the exhaust air channel in the area of the fire detecting device in the direction of the measuring chamber and then once again at the underside of the cover of the exhaust air channel, whereupon the tapped cooling air stream calms down and converts into a laminar flow. Reflection of the cooling air entering from below into the exhaust air channel is avoided at the underside of the cover of the exhaust air channel by virtue of the fact that the cooling air stream withdrawn is deflected already once in the direction of flow by the fins of the air inlet slots of the exhaust air channel box. This is particularly the problem with the devices known from the state of the art for withdrawing a fraction from a cooling air stream. If the cooling air stream issuing from the ventilated appliance hits a diverting baffle or the like at right angles, for example the underside of the cover of the exhaust air channel, a major portion of the tapped cooling air stream is reflected and whirlled up, cooling air accumulates, and that impedes or even prevents the transportation of smoke particles, for instance, to the measuring chamber.

The length of the exhaust air channel in the direction of flow, too, is variable in advantageous manner by plug-in inserts, similar to the detection chimney mentioned above, to adapt it to different quantities of air flow and also to flow velocities of different magnitude. The entire fire detecting device thus can be built in modular fashion by assembling one or more exhaust air channel units—in response to the desired length of the overall device—and connecting the measuring chamber to the end of the exhaust air channel which lies in the direction of flow.

The spacing of the fire detecting device from the air outlet of the ventilated appliance can be varied, according to an advantageous further development of the invention, by brackets to avoid reflux of cooling air, depending on the magnitude of the flow velocity of the cooling air exiting from the ventilated appliance.

The following modifications relate to both solutions according to the invention.

Preferably it is provided that two detectors, able to respond to different fire characteristic magnitudes, are arranged in the measuring chamber to improve the freedom from interference, i.e. to lower the false alarm rate. In per se known manner, the two detectors are connected in two lines to a fire alarm center. The two detectors may be smoke, gas, or heat indicators, depending on the specification requirement, with either both detectors, for example, being smoke alarms or one being a smoke alarm and the other one an indicator either of gas or heat. Additionally, a temperature sensor may be disposed in the measuring chamber or in the exhaust air channel as well. The provision of two smoke indicators suggests itself since in most cases, when a fire originates, the fire characteristic magnitude "solids or liquid proportions in the cooling air" is to be expected. In this context both optical smoke alarms (O-indicators) as well as ionisation smoke alarms (I-indicators) are used. Alternatively, in line with the respective case of need, at least one of the two detectors can be designed as a gas indicator or also as a heat indicator. While a gas indicator is directed at detecting the fire characteristic magnitude "proportion of certain gases in the appliance cooling air" the heat indicator reacts to heat radiation. The latter is to be employed, for example, where the cooling air inevitably comprises a certain proportion of solid particles, for instance, in the form of dust. Here a smoke indicator would lead to false alarms due to the dust. The heat indicator can be designed as a maximum indicator which responds when the temperature measured exceeds a certain threshold value for a given period of time, or as a differential indicator which responds when the speed of variation of the temperature measured exceeds a fixed value for a predetermined period of time, or as both maximum and differential indicator combining both capabilities. Specifically the differential measurement permits a very early indication of abnormal temperature rises of the apparatus cooling air.

According to another advantageous modification of the invention the two detectors are located opposite each and offset with respect to each other in the direction of flow of the measuring chamber. The advantage of the mutually offset and opposed arrangement of the detectors, on the one hand, is that the measuring chamber thus can do with a smaller cross section and, on the other hand, that the positioning of the detectors at different height above the air outlet of the ventilated appliance is another essential contribution to avoiding deceiving alarms.

An advantageous alternative of the mutually opposed arrangement of the detectors is to arrange them mutually offset in the direction of flow, but at the same side. In that event the detectors can be installed on a common board which is of advantage under aspects of the manufacturing technique and, on the other hand, affords considerable simplification of the maintenance of the fire detecting device because access to the detectors for maintenance purposes is required from one side only.

BRIEF DESCRIPTION OF THE DRAWINGS

A preferred embodiment of the invention will be described in greater detail below, with reference to a drawing, in which.

DETAILED DESCRIPTION OF PREFERRED EMBODIMENTS OF THE INVENTION

Figure 1:
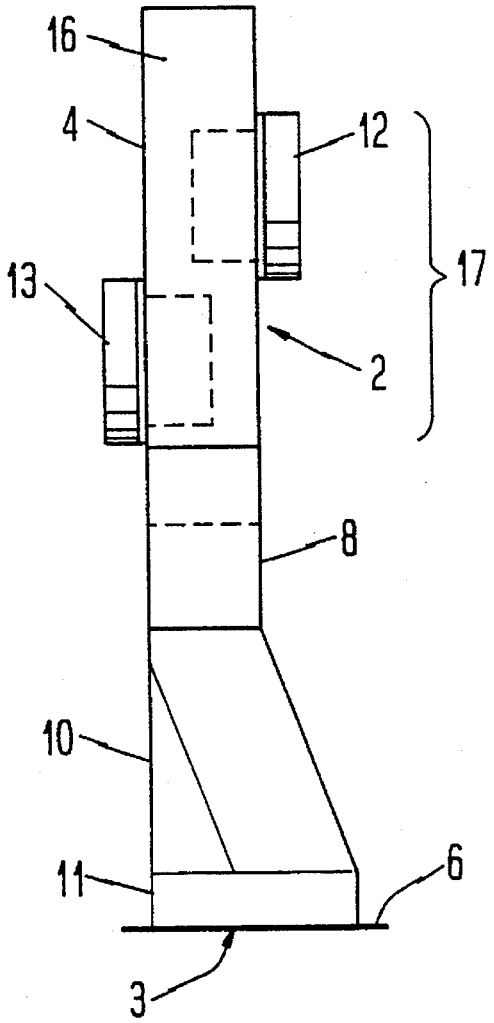
FIG. 1 is a side elevational view of a detection chimney according to the invention, comprising an exhaust air dome and an insert plugged in between the chimney and the exhaust air dome.

FIG. 1 shows a side view of a device for detecting fires in ventilated appliances or machines, essentially comprising a measuring chamber through which flows the main current of cooling air or a representative fraction withdrawn from the same, and further comprising two detectors 12, 13 in the form of smoke indicators arranged in the measuring chamber 2 in the air stream which flows through the same. The smoke detectors 12, 13 are connected by an electronic circuit (not shown) to an alarm means and an extinguishing and/or switch-off device permitting an optical and/or acoustical indication of a fire alarm as well as the direct reaction by an extinguishing process or also by switching off the appliance concerned.

The measuring chamber 2 is designed as a chimney 4 (below also: detection chimney) the length of which is variable in longitudinal direction of the cooling air stream which flows through it. Adaptation in length of the chimney 4 to the respective conditions prevailing in situ is necessary because the air flow quantity as well as the flow velocity differ from apparatus to apparatus so that flow channels 16 of different lengths are needed to generate a laminar flow zone 17. Finally, the air flow conditions also may change in modular appliances by the addition or removal of slide-in units so that an adaptation of the length of the detection chimney becomes necessary in order to obtain laminar flow. In the embodiment illustrated in FIG. 1 the length of the chimney 4 was increased by a plug-in insert 8 and, in addition, by an exhaust air dome 10. The cross section of the exhaust air dome 10 becomes greater towards the bottom and terminates in a circular cross section 11. At this circular cross section 11, the exhaust air dome 10 and thus the entire detection chimney 4 is placed on the air outlet 6 of the ventilated appliance 1 which is no longer shown here. The cooling air issuing from the air outlet 6 of the ventilated appliance enters the flow channel 16 through the lower cross sectional opening 3 of the exhaust air dome 10 or chimney 4 and is guided past the two detectors 12, 13. The two detectors 12, 13 are disposed opposite each other at different levels, both detectors overlapping each other in transverse extension, whereby the reliability of the fire detecting device is improved.

Figure 2:
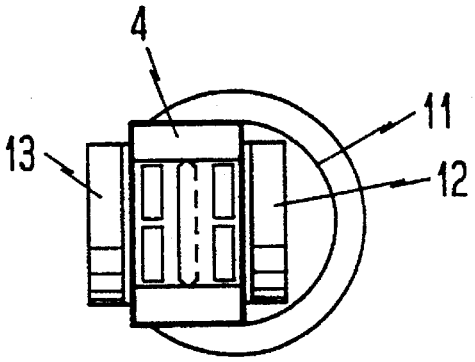
FIG. 2 is a top plan view of the detection chimney shown in FIG. 1.

FIG. 2 is a top plan view of the detection chimney 4. Based on this view, it can be seen that the exhaust air dome 10 widens downwardly into a circular cross section 11, whereby on the one hand a greater proportion of the main current of cooling air is grasped and, on the other hand, the stabilility of the overall device is enhanced.

Figure 3:
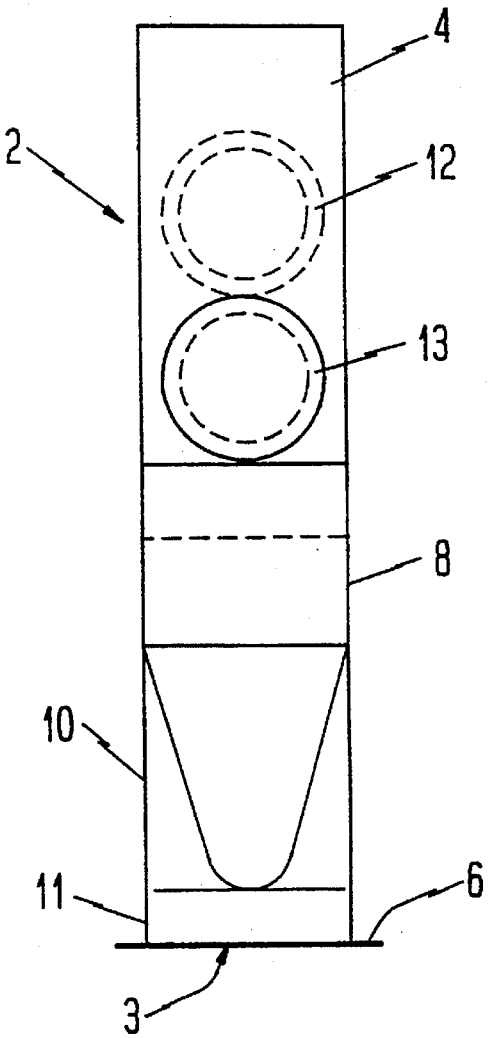
FIG. 3 is a front elevational view of the detection chimney shown in FIG. 1.

FIG. 3 shows a front view of the chimney-like measuring chamber 2 according to FIGS. 1 and 2. The variation in length of the detection chimney 4, of course, can be achieved also by a telescopic design of the chimney 4.

Figure 4:
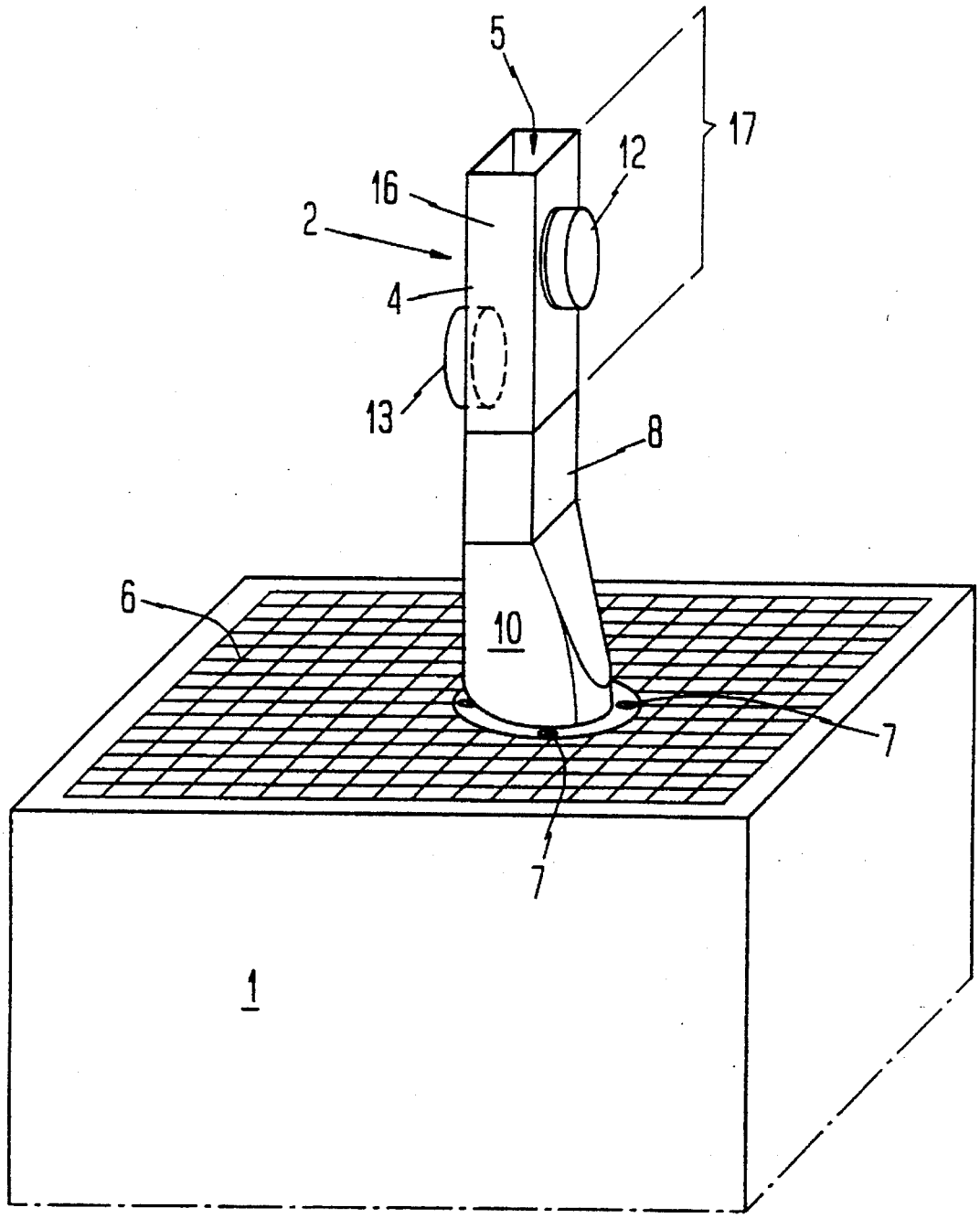
FIG. 4 shows the arrangement of a detection chimney according to FIGS. 1 to 3 on a ventilated apppliance cabinet.

FIG. 4 shows the detection chimney 4 with a plug-in insert 8 and an exhaust air dome 10 on the appliance cabinet 1 of a ventilated appliance. The circular enlargement of the exhaust air dome 10 is secured on the air outlet 6 of the ventilated appliance by mechanical connections, such as screws 7. The cooling air of the ventilated appliance enters the flow channel 16 of the measuring chamber 2 through the exhaust air dome 10, sweeping past the detectors 12, 13 as a laminar flow and leaving the detection chimney 4 through the upper cross sectional opening 5 thereof.

Figure 5:
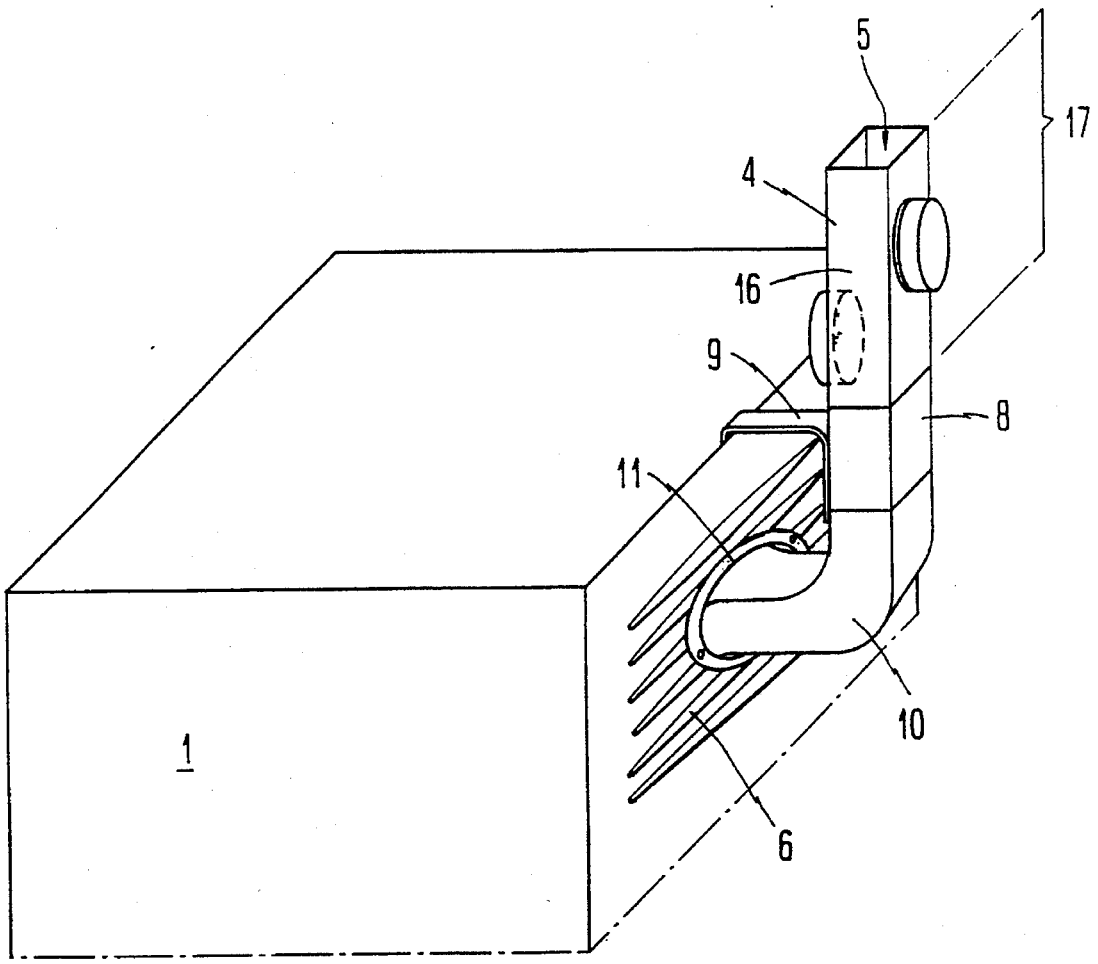
FIG. 5 shows the arrangement of a detection chimney according to FIGS. 1 to 3 at the side of a ventilated appliance cabinet with an angled exhaust air dome.

FIG. 5 shows an embodiment which is identical with the fire detecting device described above, with the exception of the design of the exhaust air dome 10. Here the detection chimney 4 is fastened to the lateral air outlet slits 6 of a ventilated appliance 1. The exhaust air dome 10 has a 90° bend so that the flow passage 16 inside the detection chimney 4 extends in vertical direction within the detection range 17. Here again the exhaust air dome 10 is of circular cross sectional design at its end and secured to the air outlet 6 by screws.

Figure 6:
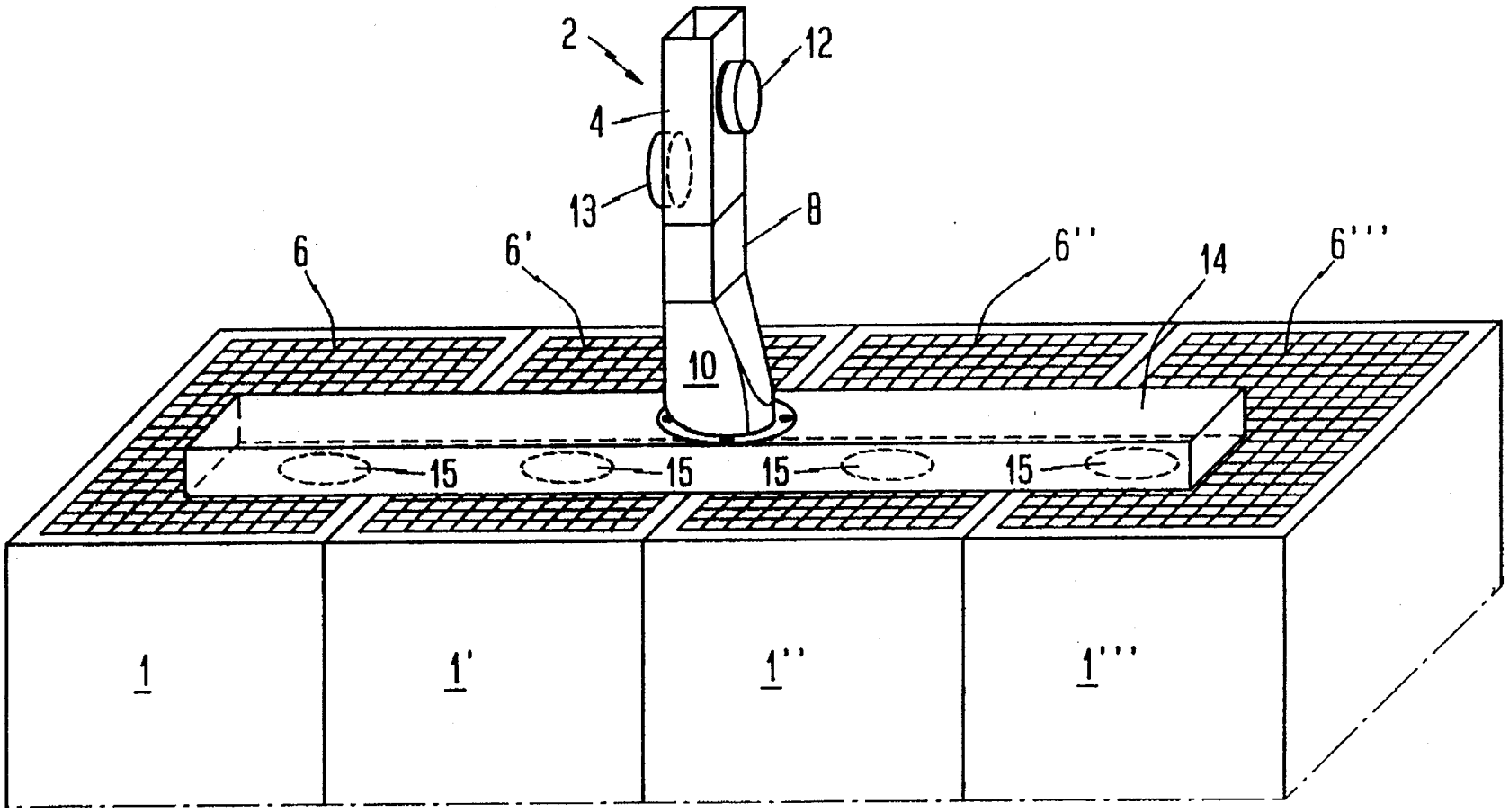
FIG. 6 shows the arrangement of a detection chimney according to FIGS. 1 to 3 on an exhaust air channel for protection of a plurality of ventilated appliances or machines.

FIG. 6 shows the embodiment of the detection chimney according to FIGS. 1 to 4 as a fire detecting device for a series of ventilated appliances 1, 1', 1", 1''' arranged side-by-side Here the detection chimney 4 is mounted by its exhaust air dome 10, which again is circularly widened in cross section, on an exhaust air channel 14 which gathers a fraction of the main current of cooling air from the air outlets 6, 6', 6", 6''' of the individual ventilated appliance cabinets through inlet openings 15. The cooling air flows withdrawn from each ventilated appliance are supplied to the detectors 12, 13 through the exhaust air dome 10 and the plug-in insert 8 as a joint air stream. With this embodiment the fire detection is effected simultaneously in each instance for the interconnected appliances 1, 1', 1", 1'''.

Figure 7:
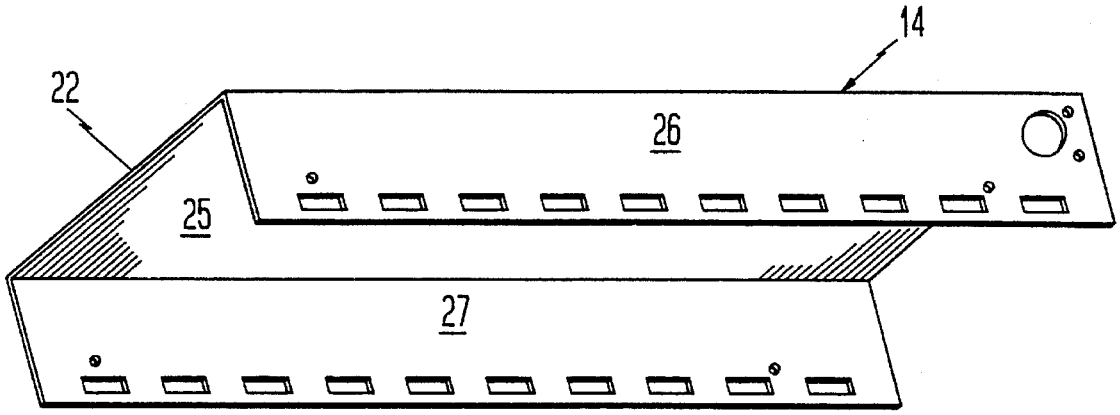
FIG. 7 is a perspective view of an exhaust air channel as component part of an alternative embodiment of a fire detecting device.

FIG. 7 shows the perspective view of an exhaust air channel 14 —or an exhaust air channel unit—as part of an alternative embodiment of a fire detecting device whose overall function will be explained below with reference to FIGS. 11 to 14. An exhaust air channel unit 14 is spoken of inasmuch as the exhaust air channel shown with an open front end in FIG. 7 also can be combined with a plurality of almost identically structured exhaust air channel units to form an exhaust air channel of any desired length.

The exhaust air channel unit 14 illustrated in FIG. 7 is of box-shaped design, including a cover 25 and sidewalls 26, 27 attached to the same. This exhaust air channel box 14 is placed with its open bottom on the air outlet 6 of the ventilated appliance 1. When an exhaust air channel box is used in the fire detecting device one of the two face ends of the exhaust air channel box 14 is closed, while the face end located in the direction of flow of the cooling air stream is connected to the measuring chamber 2 (cf. FIGS. 11 to 14). The exhaust air channel box 14 illustrated in FIG. 7 can be used wherever the air outlet 6 of the ventilated appliance includes guide baffles 29 which cause the exiting cooling air stream to issue, for instance, at an angle of 45° with respect to the plane of the air outlet (FIGS. 13 and 14).

Figure 8:
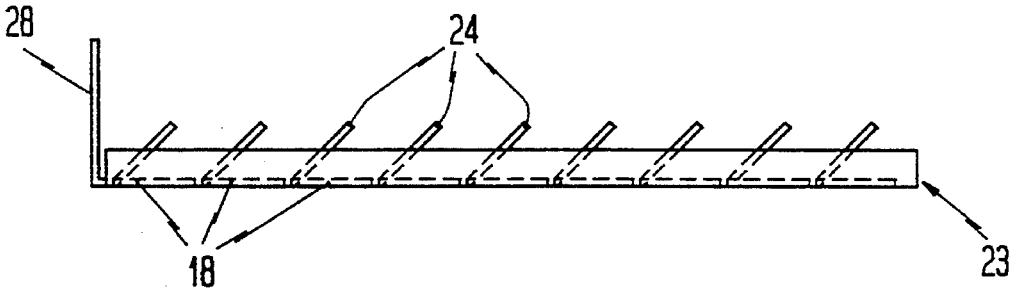
FIG. 8 is a side elevational view of an insert having fin-like ventilation slots and adapted to be inserted from below in the exhaust air channel shown in fig. 7.

FIG. 8 shows a lateral view of a lower part 23 including fin-like air inlet slots 18 and adapted to be inserted from below into the upper part 22 of the exhaust air channel 14 shown in FIG. 7. Here the lower part 23, for example, has a front end wall 28 for terminating the exhaust air channel 14 at the face end. Yet this is not needed when the exhaust air channel box 14, i.e. including the upper part 22 and the lower part 23, is installed as a central unit in a longer exhaust air channel. In such an event, of course, both face ends are open to let the cooling air pass through. At one edge each which extends transversely of the direction of flow, the fin-like air inlet slots 18 of the lower part 23 comprise fins 24 extending at an angle of approximately 45° with respect to the bottom sheet of the lower part 23, being chamfered in the direction of flow. It is the function of these fins to effect a first deflection in the direction of flow of the cooling air which enters the lower part 23 through the air inlet slots 18 substantially vertically with respect to the bottom sheet in order thus to prevent the cooling air flowing into the exhaust air channel 14 from hitting the underside of the cover 25 perpendicularly (FIG. 7) as this would cause reflux of the cooling air. Such reflux not only affects the function of the fire detecting device because transportation to the measuring chamber 2 of the smoke particles or liquid proportions in the cooling air no longer takes place or does so only with great delays in time. On the other hand, an accumulation or reflux of the cooling air is undesired on the part of the producer of the apparatus to be monitored as well as on the part of the operator thereof because undesirable overheating of structural elements may be the consequence.

Figure 9:
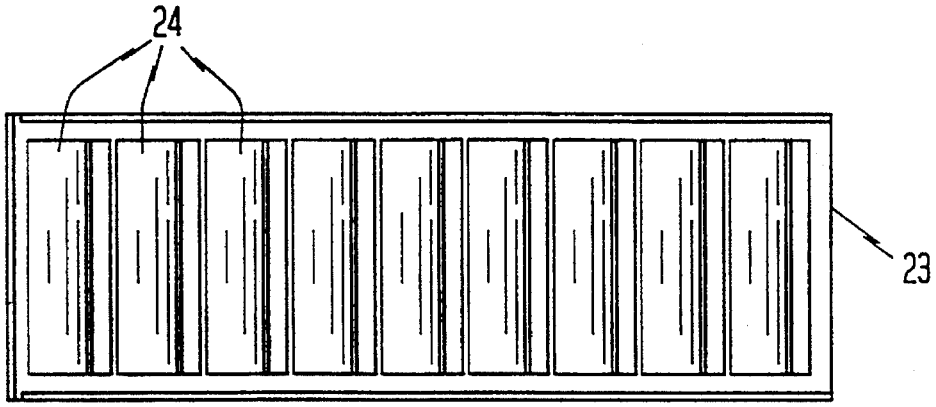
FIG. 9 is a top plan view of the insert shown in FIG. 8.

FIG. 9 shows a top plan view of the lower part 23 according to FIG. 8 to once again clarify the position of the fins 24.

Figure 10:
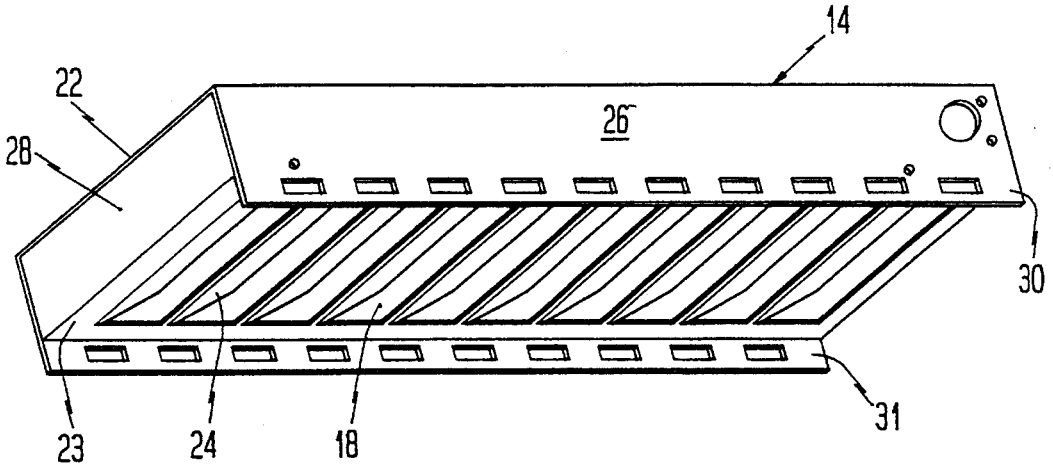
FIG. 10 is a perspective view of the exhaust air channel shown in FIG. 7 with built-in insert according to FIGS. 8 and 9.

FIG. 10 shows an exhaust air channel box 14 composed of an upper part 22 and a lower part 23. This exhaust air channel box 14 resulted from the lower part 23 according to FIGS. 8 and 9 having been inserted from below into the upper part 22 according to FIG. 7. The exhaust air channel box 14 is closed at one face end by a front end wall 28. This exhaust air channel box 14 consequently presents a unit of the type used within a longer exhaust air channel, composed of a plurality of exhaust air channel units 14, as the left end closing unit or as the only exhaust air channel unit 14. When the exhaust air channel box 14 is used as a middle unit to form a longer exhaust air channel, the front end wall 28 is dispensed with. This makes it clear that the length of the entire exhaust air channel is variable in modular fashion by combining a plurality of exhaust air channel units which also may be of different lengths. This adaptation in length provides an advantageous adaptation of the fire detecting device to the dimensions of the apparatus to be monitored and, by optimizing the length of the exhaust air channel, laminar flow of the cooling air in the exhaust air channel towards the measuring chamber can be effected especially efficiently.

For further reduction of the risk of an accumulation of air, the exhaust air channel box 14 includes bracket slats 30, 31 at its sidewalls 26, 27 which project downwardly beyond the bottom sheet of the insert 23 so that the air inlet slots of the exhaust channel box 14 are spaced from the air outlet 6 of the ventilated appliance. The height of these bracket slats—or also of the brackets 20 according to FIG. 11—can be adapted to the flow velocity of the cooling air flowing out of the ventilated appliance.

Figure 11:
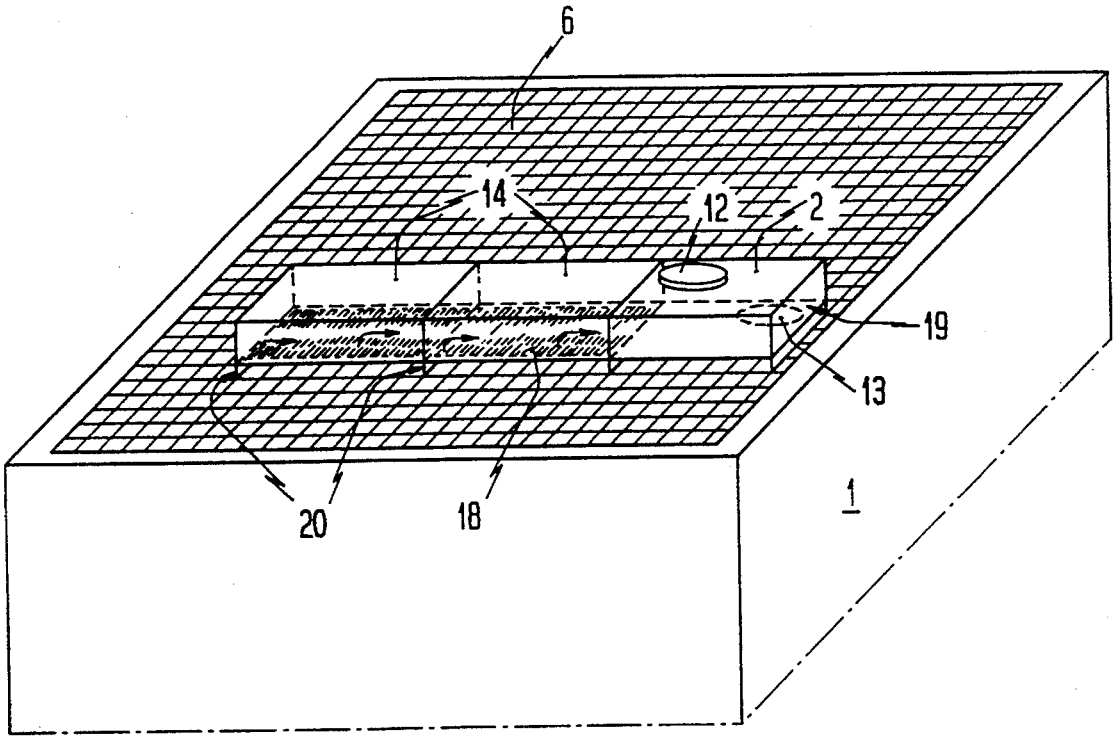
FIG. 11 shows the arrangement of a fire detecting device comprising two exhaust air channel units and a measuring chamber connected to them in flow direction on the ventilation grid of a ventilated appliance cabinet.
Figure 12:
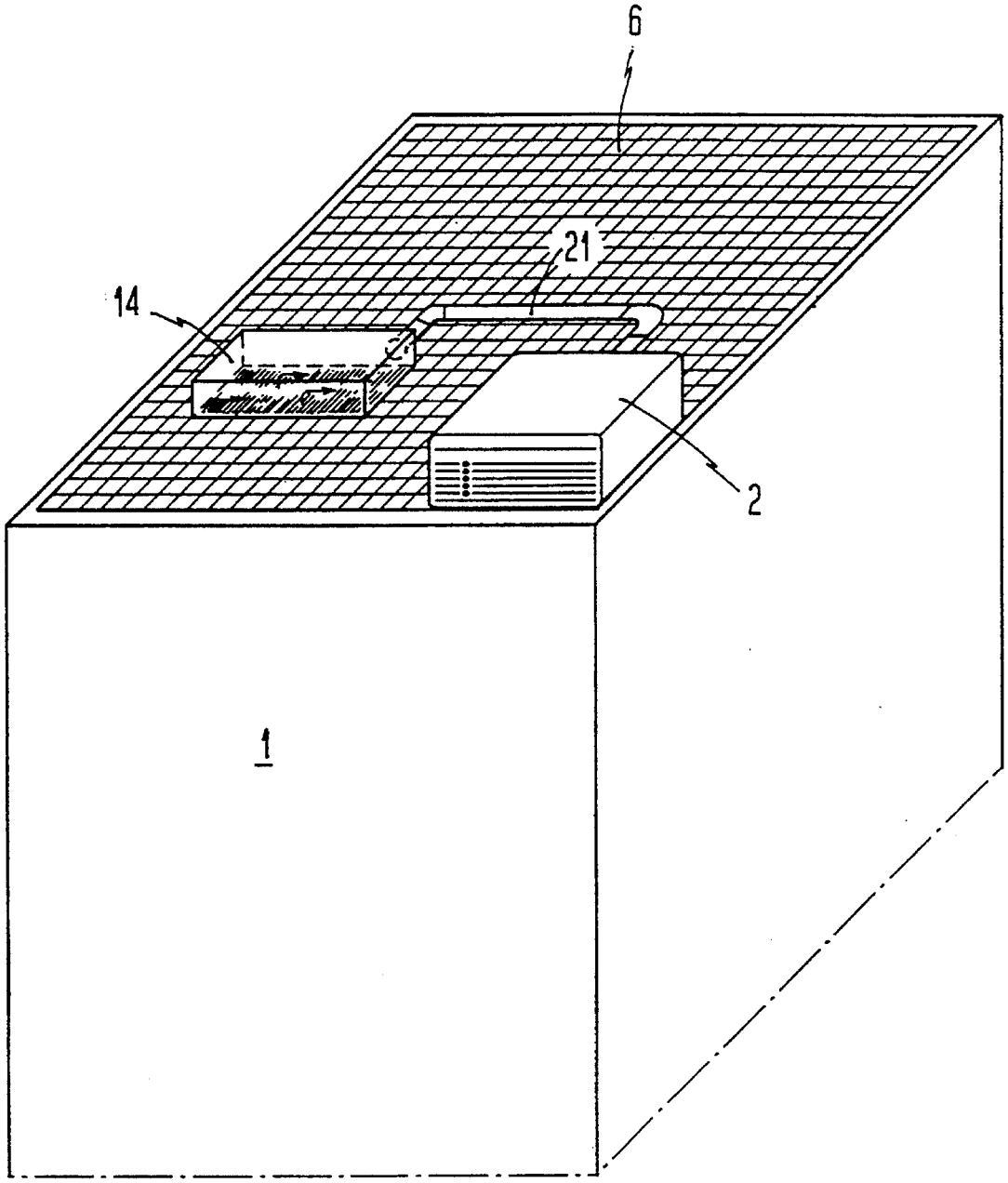
FIG. 12 shows the arrangement of an exhaust air channel unit on the ventilation grid of a ventilated appliance, the exhaust air channel being connected by means of a supply conduit to the measuring chamber.
Figure 13:
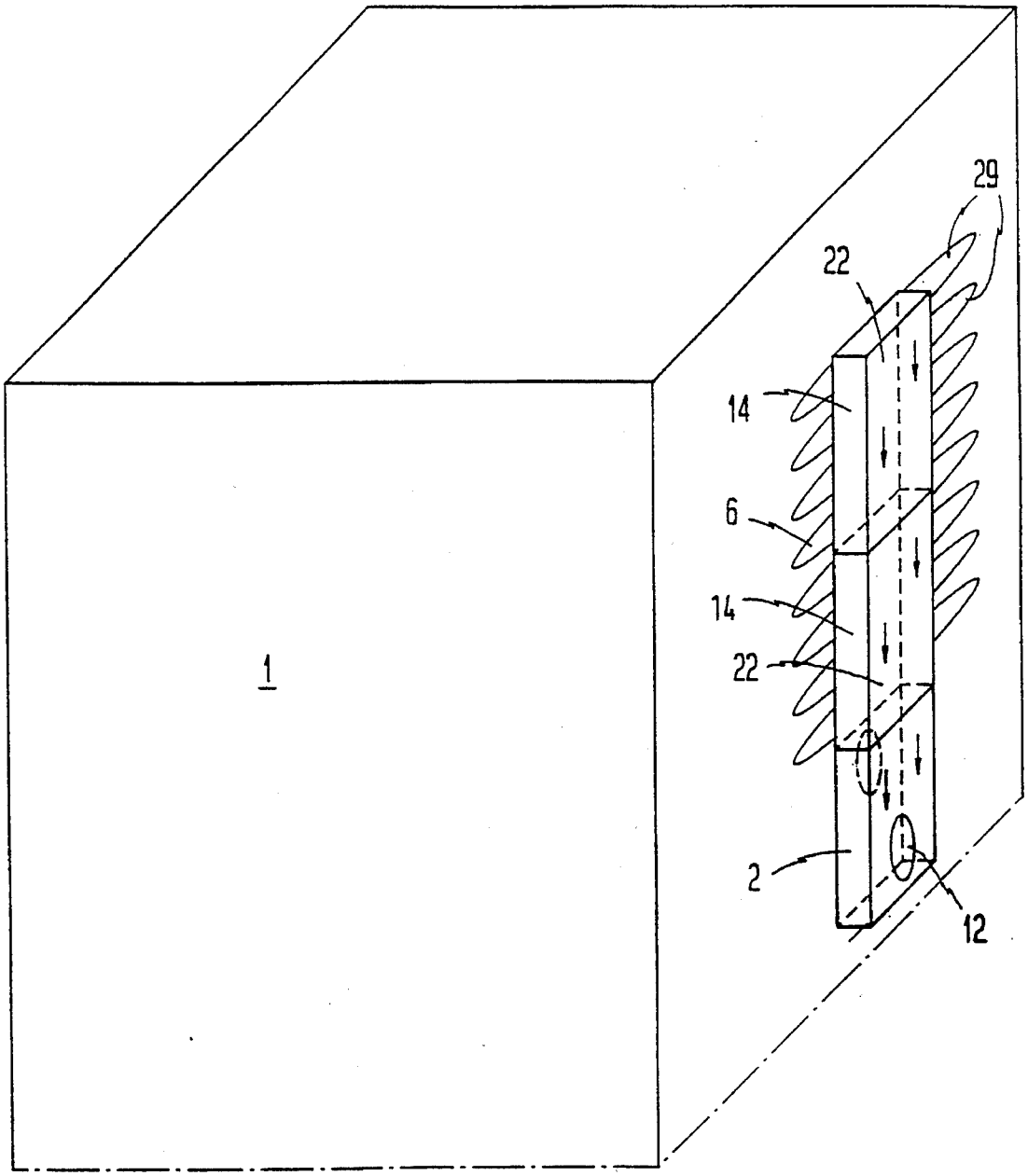
FIG. 13 shows the arrangement of two exhaust air channel units, connected directly to a measuring chamber, at the side of a ventilated appliance cabinet.
Figure 14:
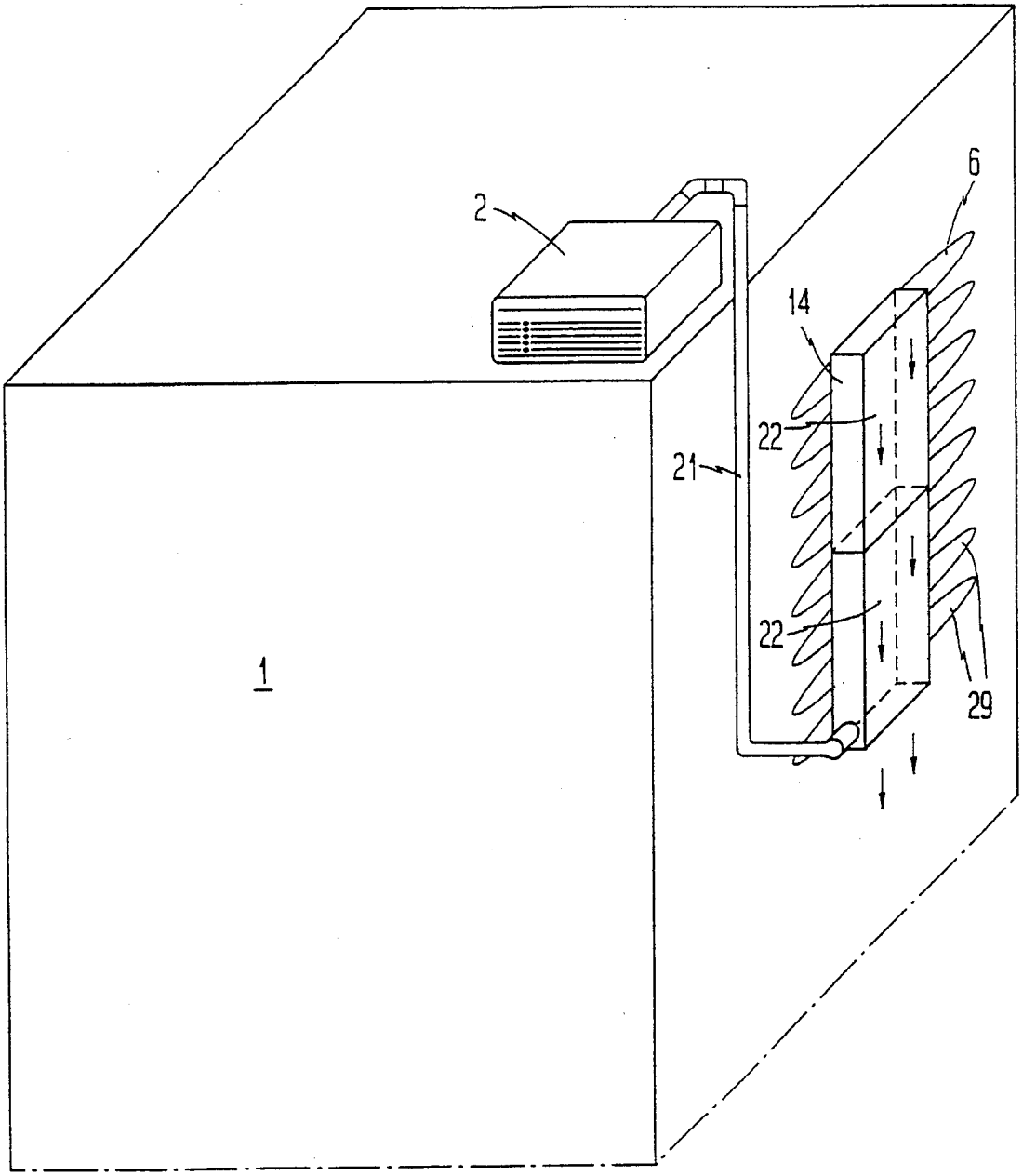
FIG. 14 is a presentation, similar to FIG. 13, of a fire detecting device at the side of a ventilated appliance cabinet, with two exhaust air channel units in this case being connected by a supply line to a measuring chamber.

FIGS. 11 to 14 illustrate a few different possibilities of application of the flat embodiment of the fire detecting device according to the invention. FIGS. 11 and 12 each are concerned with the use in an appliance cabinet 1 of which the air outlet 6 in the form of a simple grid is mounted on the top side of the appliance cabinet 1 from which the cooling air, therefore, rises substantially vertically. Two exhaust air channel units 14, coupled in flow direction with a measuring chamber 2, are arranged on the air outlet grid 6 of the appliance cabinet 1 as shown in FIG. 11. The two exhaust air channel units 14 substantially correspond to the exhaust air channel unit 14 illustrated in FIG. 10, with the difference that in the exhaust air channel units shown in FIG. 11 the bracket slats 30, 31 are replaced by transversely extending brackets 20. In the area below the exhaust air channel units 14, the cooling air which vertically leaves the air outlet 6 of the appliance cabinet 1 flows through the air inlet slots 18 into the exhaust air channel units 14 and in doing so is deflected for a first time by the fins 24 at an angle of approximately 45° in the direction of flow towards the measuring chamber 2. The second deflection of the cooling air takes place at the underside of the cover 25 of the exhaust air channel units 14 (cf. FIG. 7). On the whole, therefore, deflection by 90° takes place of the tapped fraction of the main current of cooling air, it being assured—in response to the outflowing velocity of the cooling air from the ventilated appliance 1—that a laminar flow of cooling air is formed within the exhaust air channel units 14 by selection of a corresponding length of the overall exhaust air channel. Without any deflection by the fins 24 of the cooling air entering the exhaust air channel units 14, the cooling air would impinge vertically on the underside of the cover 25 of the exhaust air channel units and that would result in reflux and accumulation. Yet the two-fold deflection of the cooling air within the exhaust air channel and the corresponding adaptation in length of the exhaust air channel make sure that the tapped fraction of the main current of cooling air will enter the measuring chamber 2 as a laminar flow, the cooling air being able to sweep past the two detectors 12, 13 and leave the measuring chamber 2 at the front end 19.

FIG. 12 illustrates the use of another embodiment of the fire detecting device on the same ventilated appliance cabinet 1. Once more the cooling air exits substantially vertically from the air outlet 6 of the ventilated appliance 1. Other than with the ventilated appliance cabinet 1 of FIG. 11, however, here the cooling air issues at such low flow velocity that a measuring chamber 2 is used which actively aspires the tapped fraction of the cooling air through a supply line 21 from the exhaust air channel box 14 by means of a fan of its own. At such low flow velocities, also the spaced arrangement of the exhaust air channel from the air outlet grid by means of brackets 20 (cf. FIG. 11) or by projecting bracket slats 30, 31 (cf. FIG. 10) may be dispensed with. Active aspiration can be dispensed with only, and a fire detecting device according to FIG. 11 be used, beginning at exhaust air velocities of about >2 m per second.

FIGS. 13 and 14 each show a ventilated appliance cabinet 1 with which the cooling air already leaves the air outlet 6 of the ventilated appliance 1 at a certain angle. Deflection of the cooling air here is effected by air guide baffles 29 which already are available at the appliance cabinet end and deflect the cooling air in the two cases illustrated by about 45° in downward direction. The fire detecting devices in both cases of FIGS. 13 and 14 are composed of two exhaust air channel units 14 which in this instance, however, consist only of the upper parts 22 according to FIG. 7 and of a measuring chamber 2 each. As the cooling air leaving the ventilated appliance 1 through the air outlet 6 enters the exhaust air channel 14 already deflected in flow direction by the guide baffles 29, provision of the lower part 23 according to FIGS. 8 and 9 is not necessary in the instant case. The cooling air which already enters the exhaust air channel 14 in oblique downward direction is deflected once more in flow direction at the underside of the covers 25 of the exhaust air channel units 14 so that here again a laminar cooling air flow results in the direction of the measuring chamber 2.

In correspondence with the differences between FIGS. 11 and 12, different measuring chambers 2 are used also with the appliance cabinets of FIGS. 13 and 14. The ventilated appliance 1 according to FIG. 13 is an appliance with which the cooling air exits from the air outlet 6 at a flow velocity which is higher than approximately 2 m per second. Therefore, active aspiration of the cooling air from the exhaust air channel can be dispensed with since the flow velocity of the cooling air proper is sufficient for conveying the tapped fraction of the cooling air through the exhaust air channel to the measuring chamber 2.

The appliance cabinet 1 illustrated in FIG. 14 is a ventilated appliance with which the cooling air flow velocity upon leaving the air outlet 6 is not sufficient to warrant reliable conveyance of the tapped cooling air quantity through the exhaust air channel 14 to the measuring chamber 2. For this reason the measuring chamber 2 once more comprises a fan by which the tapped cooling air is sucked through a supply line 21 from the exhaust air channel 14 and fed to the detectors in the measuring chamber 2.

What is claimed is:

1. A device adapted for attachment to and for detecting fire in ventilated appliances and machines and comprising:

a measuring chamber in the form of a chimney having a lower cross sectional opening adapted to be placed on at least a part of an air outlet of a ventilated appliance or machine to receive at least a portion of ventilated air from the appliance or machine for flow through said measuring chamber;

at least one fire detecting means positioned in said measuring chamber in the path of air flow through said measuring chamber for sensing a fire; and means for extending the length of said chimney comprising a plug-in insert portion for being connected between said measuring chamber and the air outlet.

2. A fire detecting device, as set forth in claim 1, in which said measuring chamber further includes an air dome means having a lower portion forming said lower cross sectional opening and an upper portion having a cross section which widens toward said lower cross sectional opening.

3. A device adapted for attachment to and for detecting fire in ventilated appliances and machines and comprising:

a measuring chamber in the form of a chimney having a lower cross sectional opening;

an air box means connected to said lower cross sectional opening of said measuring chamber and adapted to be placed on at least a part of an air outlet of a plurality of ventilated appliances or machines to receive at least a portion of ventilated air from the appliances or machines to flow through said air box means and into and through said measuring chamber; and at least one fire detecting means positioned in said measuring chamber in the path of air flow therethrough for sensing a fire.

4. A device adapted for attachment to and for detecting fire in ventilated appliances and machines and comprising:

a measuring chamber in the form of a chimney having a lower cross sectional opening adapted to be placed on at least a part of an air outlet of a ventilated appliance or machine to receive at least a portion of ventilated air from the appliance or machine for flow through said measuring chamber; and at least two fire detecting means positioned in said measuring chamber in the path of air flow therethrough for sensing different characteristics of a fire.

5. A fire detecting device, as set forth in claim 4, in which said two fire detecting means are located on opposite sides of said measuring chamber and offset with respect to each other in the direction of air flow through said measuring chamber.

6. A device adapted for attachment to and for detecting fire in ventilated appliances and machines and comprising:

a measuring chamber in the form of a flat box having two opposed open sides for receiving air at one of said open sides and for allowing the air to flow through said measuring chamber;

an air channel box having a cover wall, side walls, one open side and an open bottom and being attached to said measuring chamber at one of said measuring chamber open sides and being adapted to be placed on at least a part of an air outlet of a ventilated appliance or machine to receive at least a portion of ventilated air from the appliance or machine for flow through said air channel box and through said measuring chamber; and at least one fire detecting means positioned in said measuring chamber in the path of air flow therethrough for sensing a fire.

7. A fire detecting device, as set forth in claim 6, in which said air channel box comprises a two-part design including an upper part and a lower part, one of said parts being adapted to be inserted into the other and in which said upper part includes said cover wall and two of said side walls in opposing relation and said lower part includes spaced fins inclined in the desired direction of air flow through said air channel box and defining inlet slots in said open bottom of said air channel box.

8. A fire detecting device, as set forth in claim 6, in which said at least one fire detecting means comprising two detectors adapted to respond to different fire characteristics.

9. A fire detecting device, as set forth in claim 8, in which said two detectors are located on opposite sides of said measuring chamber and offset with respect to each other in the direction of air flow through said measuring chamber.

* * * * *